US006077123A

United States Patent [19]

Frank et al.

[11] Patent Number: 6,077,123

[45] Date of Patent: Jun. 20, 2000

[54] CONTACT PLATE FOR BASES OF ELECTRIC LAMPS

[75] Inventors: József Frank, Landorhegyi; József Fülöp, Bolgárkertész; Ákos Ocsovai, Erdöalja; Ferenc Papp, Ugró Gyula; Zoltán Szántó , Nemzetór; István Würsching, Erzsébet, all of Hungary

[73] Assignee: General Electric Company, Schenectady, N.Y.

[21] Appl. No.: 09/177,195

[22] Filed: Oct. 22, 1998

[30] Foreign Application Priority Data

Nov. 20, 1997 [HU] Hungary ..... 9702173

[51] Int. Cl.[7] ..... H01K 1/00

[52] U.S. Cl. ..... 439/611; 313/318; 313/317

[58] Field of Search ..... 313/317, 318.01–318.12; 439/611–619, 734, 735

[56] References Cited

U.S. PATENT DOCUMENTS

| | | | |
|---|---|---|---|
| 3,897,124 | 7/1975 | Pagnotta et al. | 439/615 |
| 4,866,331 | 9/1989 | Livera | 313/318.03 |
| 5,039,905 | 8/1991 | Essers et al. | 313/318.01 |
| 5,306,179 | 4/1994 | Korenowski | 439/734 |

*Primary Examiner*—Paula Bradley
*Assistant Examiner*—Ross Gushi
*Attorney, Agent, or Firm*—Fay, Sharpe, Fagan, Minnich & McKee, LLP

[57] ABSTRACT

Lamp base contact plate for connecting a current lead-in wire of an electric lamp to a contact part of a lampholder, which contact plate being a pressed metal part of the lamp base and having a through bore for the lamp lead-in wire, is fixed firmly on an electrically insulating insert closing the end of a shell of the lamp base. The through bore for the lamp lead-in wire is formed as a first perforated bore (12) with torn skirt (20) protruding from the plane (L) of the contact plate (10) in a direction away from the insulator insert (30), and the contact plate (10), in addition to this first perforated bore (12), also includes at least two further perforated bores (14, 16, 18), each having a torn skirt (22, 24, 26) protruding from the plane (L) of the contact plate (10) in a direction opposite to the direction of the torn skirt (20) of the first perforated bore (12), towards the insulator insert (30). The contact plate (10) is optionally also provided with a continuous rim (28) protruding in a stepped manner from the plane (L) of the contact plate (10) on the side of the torn skirt (20) of the first perforated bore (12) and being at least approximately parallel to the plane (L) of the contact plate (10).

17 Claims, 1 Drawing Sheet

CONTACT PLATE FOR BASES OF ELECTRIC LAMPS

BACKGROUND OF THE INVENTION

1. Field of the Invention

This invention relates to the construction of bases of electric lamps. More particularly, the subject of the present invention is a contact plate structure for the bases of electric lamps which contact plate is a metal part having a through bore for the lead-in wire of the lamp.

2. Discussion of the Art

The majority of electrical lamps is provided with a standard base which can be inserted into a standard lampholder enabling both the releasable fixing of the lamp in operational position and the connection thereof to the electric mains. In addition to the construction elements ensuring the releasable mechanical fixing and replacement of the lamp, the base also comprises contacts of metal material for connecting the lamp to the electric power supply. The lamp bases can be various depending on the character, purpose, type as well as the geographical place of use of the lamp. However, the group of typical lamp bases of probably the most widespread use is made up of bases comprising the following parts: a metal base shell being also connected with the lead-in wire of the lamp and having the shape of a body of rotation, an insulator insert closing the end of this base shell, and one or more contact plates fixed to the insulator insert and insulated from the base shell and optionally also from each other by the said insulator insert. In the case of bases with probably the most widespread use, the contact plates are fixed by an adhesive glass-to-metal seal and in some cases also by partial embedding to a so-called vitrite insert pressed from a molten glass frit. The contact plates have a bore, through which a lead-in wire of the lamp is passed during the so-called basing operation of the highly automated process of lampmaking. After combining the base and the light source, the protruding end of the lead-in wire is cut to length and the remaining part thereof is fixed to the contact plate by soldering and in some cases by welding.

Making the joint between the contact plate and the lead-in wire, and the bond between the contact plate and the insulator insert as well as the permanent mechanical strength of this bond are partly interrelating problems of lampmaking. Owing to cost reduction and environment protection considerations, fixing the inlead to the contact plate by welding has recently become an important possible replacement of soldering. When the lamp is thrown in garbage after the end of its life, soldered joints cause a significant lead contamination due to the substantial quantity of lead used. However, as known from U.S. Pat. No. 5,039,905, making the joint by welding produces a heat shock which far exceeds the heat shock produced by soldering. This may often cause a break or crack in the glass insulator insert which occur particularly in the case of contact plate constructions having metal surfaces partly embedded in the vitrite.

Another frequently occurring contact plate and base construction problem is that the electrical connection between the contact plate of the lamp and the corresponding mains contact of the lampholder comes into being generally in the region of the soldered or welded joint described above. This region does not have exactly definite shape and dimensions, which can be the source of an uncertain or insufficient electrical contact between the lampholder and the base. According to the solution of U.S. Pat. No. 3,897,124, this problem is proposed to be resolved by forming a rim protruding from the plane of the contact plate and surrounding the place of joint between the contact plate of the base and the lead-in wire of the lamp. This solution improves the reliability of the connection between the base and the lampholder by making the connection independent of the place of soldered or welded joint. It has however not gained a widespread use, caused probably by the difficulties of embedding the contact plate into the insulator insert.

BRIEF SUMMARY OF THE INVENTION

The objective of the invention was to create a lamp base contact plate, which enables making connection between the lamp lead-in wire and the said plate simply whether with soldering or welding as well as to make a joint of sufficient strength between the contact plate and the insulator insert wherein the joint also withstands even a welding between the contact plate and the lamp lead-in wire without any damage to the insulator insert. In addition, the contact plate has optionally to allow the operational electrical connection between the contact plate and the mains contact of the lampholder to come into being in a place separated in space from the place of joint rather than in the place of joint.

The objective set is achieved by constructing and using lamp base contact plates which can be pressed simply, and their bore for the lamp lead-in wire is formed as a first perforated bore with a torn skirt, which protrudes from the plane of the contact plate in a direction away from the insulator insert to which the contact plate is fixed firmly. In addition to this first perforated bore, the contact plate also includes at least two further perforated bores with torn skirts protruding from the plane of the contact plate in opposite direction, towards the insulator insert. The first perforated bore made for the lead-in wire of the lamp is surrounded by a skirt with sharp teeth having a high surface area however containing a small quantity of material due to the local thinning and tear of the material caused by the perforation. The lead-in wire passed through the bore can be welded safely and easily by means of a small quantity of heat energy even with arc welding. The small energy welding exposes the insulator insert supporting the contact plate to a small heat shock only. The skirts of the further bores made on the contact plate have the same character as the skirt surrounding the first perforated bore. However, since the perforated bores contain a relatively small quantity of material distributed over a large surface area, they are very suitable for ensuring the high mechanical strength of the bond between the insulator insert and the contact plate.

It is an advantage of the solution according to the invention that it enables fixing the lead-in wire by soldered joint and welded joint both, the consequence of which is that it practically gives the opportunity for replacing the soldered joint by a welded one. This results in the reduction of the lead contamination of the environment as well as in the reduction of the energy requirement of making the joint. When the soldered joint is chosen, it can be performed with using significantly less solder material compared to the existing techniques.

BRIEF DESCRIPTION OF THE DRAWINGS

In the following, the essential and preferable features of the invention will be illustrated by an example of the lamp base contact plate in which the invention is embodied with reference to the figures of the attached drawing. In the drawing.

DETAILED DESCRIPTION OF THE INVENTION

Figure 1:
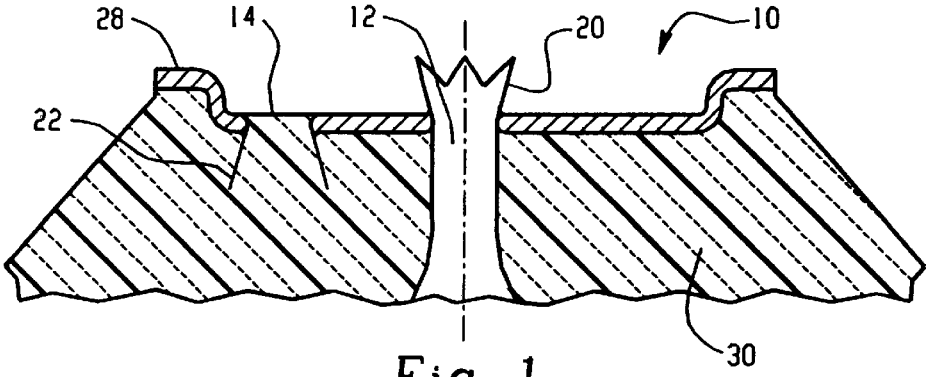
FIG. 1 is a sketch section showing an example of the contact plate embedded in vitrite used as the insulator insert of the lamp base.
Figure 2:
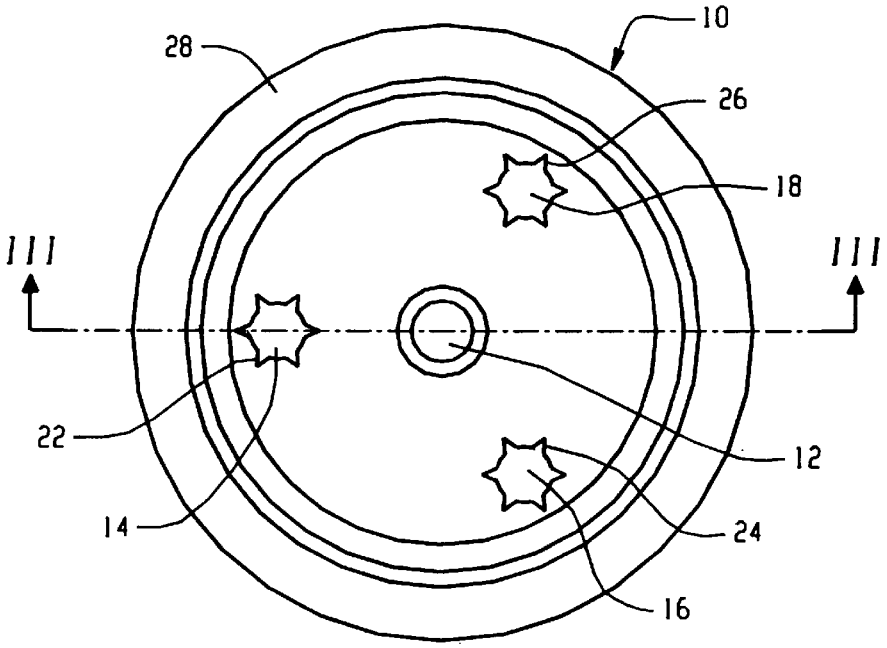
FIG. 2 is an example of the contact plate viewed from the insulator insert.
Figure 3:
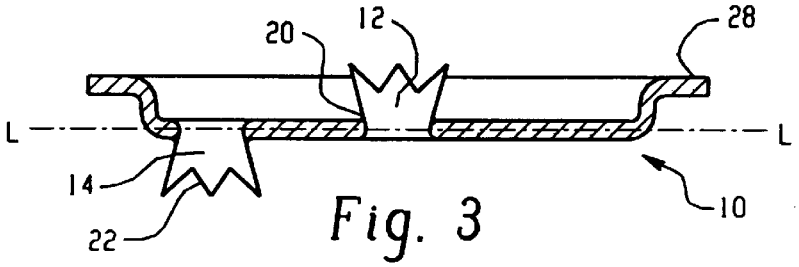
FIG. 3 is the section of the contact plate along the plane III—III seen in FIG. 2.

The invention will be disclosed by means of an example of the contact plate 10 in which the invention is embodied and which can be used preferably as a central contact fixed to an insulator insert 30 of a lamp base. This insulator insert 30 is used primarily in the so-called Edison-type lamp bases having a threaded base shell. The insulator insert 30 is made of a vitrite material pressed from molten glass frit. It is seen clearly in the drawing that the bore for the lamp lead-in wire is formed as a first perforated bore 12 with a torn skirt 20 protruding from the plane L of the contact plate 10 in a direction away from the insulator insert 30. The contact plate 10, in addition to the first perforated bore 12, also includes further perforated bores 14, 16 and 18 having torn skirts 22, 24 and 26, respectively. Unlike the torn skirt 20 of the first perforated bore 12, the torn skirts 22, 24, 26 of further perforated bores 14, 16, 18 protrude from the plane L of the contact plate 10 towards the insulator insert 30 fixing this contact plate 10. In the case of the embodiment according to the example, the contact plate 10 is formed as a circular-shaped central contact of a lamp base having the shape of a body of rotation, and the first perforated bore 12 is made in the region of the centre of the circle. The further perforated bores 14, 16 and 18 are arranged around the first perforated bore 12 with equal divisions. The contact plate 10 is also provided with a continuous rim 28 which protrudes in a stepped manner from the plane L of the contact plate 10 on the same side of the contact plate where the torn skirt 20 of the first perforated bore 12 is placed. The continuous rim 28 is parallel to the plane L of the contact plate 10. The further perforated bores 14, 16 and 18 are formed in a region of the plane L bordered by the annular-shaped rim 28. It is seen clearly in the section sketch of FIG. 1, in connection with the torn skirt 22 of the further perforated bore 14 falling in the plane of section, that the torn skirts of further perforated bores are embedded into the glass material of the insulator insert 30 in a way significantly increasing the mechanical strength of the glass-to-metal seal. Due to the rim, a clearly defined electric contact region is formed on the contact plate 10, which region provides a safe electrical contact with a corresponding mains contact element of the lampholder (not shown).

The solution according to the invention is, of course, not limited to the disk-shaped embodiment shown above as an example only. Within the scope of protection defined by the attached claims, differently shaped contact plates, e.g. oval contact plates used in pairs may also be formed which are not provided necessarily with the rim protruding from the plane of plate, and the number of perforated bores may also be different if needed. It has proven to be preferable, particularly in the case of contact plates without rim, to place the further perforated bores in the region of or adjacent to the edge of the contact plate.

What is claimed is:

1. A lamp base contact plate for connecting a current lead-in wire of an electric lamp to a contact part of a lampholder, said contact plate being a pressed metal part of the lamp base and having a through bore for the lamp lead-in wire, is fixed firmly to an electrically insulating insert closing the end of a shell of the lamp base wherein the through bore for the lamp lead-in wire is formed as a first perforated bore (12) with a torn skirt (20) protruding from a plane (L) of said contact plate (10) in a direction away from the insulator insert (30), and said contact plate (10), in addition to said first perforated bore (12), also includes at least two further perforated bores (14, 16, 18), each having a torn skirt (22, 24, 26) protruding from the plane (L) of said contact plate (10) in a direction opposite to the direction of the torn skirt (20) of said first perforated bore (12), towards the insulator insert (30).

2. The lamp base contact plate of claim 1 in which said further perforated bores (14, 16, 18) are placed in the region of or adjacent to the edge of the contact plate (10).

3. The lamp base contact plate of claim 1 in which said contact plate (10) is also provided with a continuous rim (28) protruding in a stepped manner from the plane (L) of said contact plate (10) on the side of the torn skirt (20) of said first perforated bore (12) and being at least approximately parallel to the plane (L) of said contact plate (10).

4. The lamp base contact plate of claim 1 in which said contact plate(10) is constructed as a circular-shaped central contact of the lamp base having the shape of a body of rotation and said first perforated bore (12) is formed in the vicinity of the centre of the circle.

5. The lamp base contact plate of claim 4 in which said further perforated bores (14, 16, 18) are arranged around said first perforated bore (12) with equal divisions.

6. The lamp base contact plate of claim 4 in which said contact plate (10) is provided with a continuous annular-shaped rim (28) being parallel to the plane (L) of said contact plane (10) and said further perforated bores (14, 16, 18) are arranged in a region of said plane (L) bordered by the rim (28).

7. A lamp base contact plate for connecting a lead wire to the contact plate and connecting the contact plate to an insulating material, the contact plate comprising:

first and second substantially planar opposed surfaces; and a first opening through the plate dimensioned to receive a lead wire and having a skirt portion in surrounding relation extending outwardly from the first surface in a direction opposite to the second surface, and at least a second opening through the plate having a skirt portion in surrounding relation and extending outwardly from the second surface in a direction opposite to the first surface for receipt in an associated insulating material.

8. The contact plate of claim 7 further comprising a third opening through the plate having a skirt portion in surrounding relation and extending outwardly from the second surface in a direction opposite to the first surface for receipt in an associated insulating material.

9. The contact plate of claim 7 further comprising a rim extending from the first surface in a direction opposite to the second surface for establishing electrical contact with an associated contact of a lampholder.

10. The contact plate of claim 9 wherein the rim is disposed along the perimeter of the contact plate.

11. The contact plate of claim 9 wherein the rim protrudes in a stepped manner from the first surface.

12. The contact plate of claim 9 wherein the rim is circumferentially continuous.

13. The contact plate of claim 12 wherein the rim is disposed along the perimeter of the contact plate.

14. The contact plate of claim 7 wherein the first opening is centrally located in the plate.

15. The contact plate of claim 14 wherein the second opening is interposed between the first opening and a periphery of the plate.

16. The contact plate of claim 7 further comprising third and fourth openings through the plate each having a skirt portion in surrounding relation and extending outwardly from the second surface in a direction opposite to the first surface for receipt in an associated insulating material.

17. The contact plate of claim 16 wherein the second, third, and fourth openings are disposed in substantially equi-spaced, circumferential relation.

* * * * *